United States Patent [19]

Milner

[11] Patent Number: 4,837,135

[45] Date of Patent: Jun. 6, 1989

[54] ELECTRON BEAM RECORDING FILM

[75] Inventor: Clifford E. Milner, Rochester, N.Y.

[73] Assignee: E. I. Du Pont de Nemours and Company, Wilmington, Del.

[21] Appl. No.: 85,028

[22] Filed: Aug. 13, 1987

[51] Int. Cl.[4] ..... G03C 1/30; G03C 1/94

[52] U.S. Cl. ..... 430/524; 430/527; 430/530; 430/621; 430/954

[58] Field of Search ..... 430/530, 524, 954, 621, 430/537, 539, 63, 527

[56] References Cited

U.S. PATENT DOCUMENTS

| | | | |
|---|---|---|---|
| 3,428,451 | 2/1969 | Trevoy | 96/1 |
| 3,630,873 | 12/1971 | Moore et al. | 204/192 |
| 3,862,843 | 1/1975 | Lerner | 430/566 |
| 3,864,132 | 2/1975 | Rasch et al. | 430/954 |
| 3,928,037 | 12/1975 | DeHaes et al. | 430/227 |
| 3,973,967 | 8/1976 | Lerner | 430/413 |
| 4,025,339 | 5/1977 | Kuehnle | 430/63 |
| 4,076,406 | 2/1978 | Talmage et al. | 430/103 |
| 4,242,433 | 12/1980 | Kuehnle et al. | 430/67 |
| 4,394,441 | 7/1983 | Kawaguchi et al. | 430/530 |
| 4,518,681 | 5/1985 | Johnson et al. | 430/537 |
| 4,675,274 | 6/1987 | Ueda et al. | 430/407 |

FOREIGN PATENT DOCUMENTS

| | | | |
|---|---|---|---|
| 0256141 | 12/1985 | Japan | 430/537 |

OTHER PUBLICATIONS

John B. Fenn, Jr., "Sputter Deposited Thin Film Coatings for Use in Electro-Imaging", Advanced Printing of Conference Summaries' for the 40th Annual SPSE Conference, Rochester, New York, May 17-22, 1987, pp. 265-268.

*Primary Examiner*—Paul R. Michl
*Assistant Examiner*—Lee C. Wright

[57] ABSTRACT

An electron beam recording film comprising a support bearing, in order, (A) a sputtered layer of indium-ion oxide, and (B) a gelatino silver halide emulsion layer, e.g., silver iodobromide, crosslinked with 2 to 10% by weight based on the weight of gelatin in the emulsion layer of a $Cr^{+3}$-containing compound, e.g., chrome alum, chromic choloride, etc.

Optionally other layers can be present in the film, e.g., crosslinked gelatin overcoat, subbing layer on support, titanium oxide layer on the indium-tin oxide layer.

22 Claims, No Drawings

ELECTRON BEAM RECORDING FILM

TECHNICAL FIELD

This invention relates to an electron beam recording film. More particularly this invention relates to an electron beam recording film having excellent adhesion of its various layers and a process for the preparation of such film.

BACKGROUND OF INVENTION

Geophysics is an area of science that is becoming increasingly important. Geophysical exploration today generates very large amounts of data that must be accurately processed and displayed. Plotters such as cathode ray tube (CRT) or laser plotters are used but are slow. It is therefore recognized that the need exists for an instrument which is not only faster but provides accurate processing and display. An instrument which meets these requirements has been developed by Texas Instruments, Inc. in conjunction with Image Graphics, Inc., Fairfield, CN, and called TIADD (Texas Instruments Automatic Data Display). The instrument not only provides high quality seismic sections, aerial or satellite imagery but makes useful plots or maps. Ultra high resolution is achieved by means of electron beam recording directly onto an electron beam recording film which is a special film having a support, an electrically conductive layer, and a silver halide emulsion layer having appropriate sensitivity to the electron beam of the instrument. The conductive layer beneath the emulsion layer is present to bleed off or remove the negative change that gradually may build up on the surface of the film causing an undesired deflection of the electron beam which in turn causes a distorted record.

Trevoy U.S. Pat. No. 3,428,451 describes films said to be useful for electron beam recording. One of the films described has, in order, on a subbed polyester support (1) machine-coated cuprous iodide electrically conductive layer, (2) resin protective layer, (3) cellulose nitrate subbing, (4) gelatin subbing, and (5) gelatin-silver halide photographic emulsion. Various cuprous and silver halides, halides of other metals, etc., are disclosed as being useful as semiconductor compounds. The films described require multiple layers to separate the electrically conductive layer from the emulsion layer and provide necessary adhesion.

To obtain a useful work copy of a geophysicists record the following steps may be accomplished:

1. seismic data is acquired, e.g., on magnetic tape;
2. the data is readied for input into a suitable instrument, by way of illustration the TIADD described above;
3. an electron beam recording film is exposed in the instrument;
4. the recording film is reversal processed;
5. the processed film is enlarged, e.g., 5 to 10X on an enlarger, followed by conventional negative development; and
6. the enlarged film is contact copied onto photo paper to provide the working copy.

The electron beam recording film must have the appropriate sensitivity to the electron beam of the instrument and should be reversal processible with good Dmax and resolution. As indicated above such a recording film has a highly electrically conductive layer beneath the emulsion layer, e.g., in the range of 400 to 4000 ohms/square. The conductive layer, e.g., indium-tin oxide (ITO), may be applied to the support by a sputtering process, e.g., as described in Moore et. al. U.S. Pat. No. 3,630,873 and in an article by John B. Fenn, Jr., entitled "Sputter Deposited Thin Film Coatings For Use In Electro-Imaging", Advanced Printing of Conference Summaries' For the 40th Annual SPSE Conference, Rochester, New York, May 17–22, 1987, pp 265 to 268. Such a recording film, however, is disadvantageous because it is difficult to effectively wet anchor a gelatino based silver halide emulsion layer to the conductive layer. During wet processing of the recording film, in particular, the emulsion may become detached. The use of adhesion promoting agents, e.g., organic type hardeners such as formaldehyde, dimethylurea, glyoxal, in the emulsion layer has not been found to improve the adhesion.

It has been found that the above disadvantage can be overcome and an improved electron beam recording film obtained by incorporating into the emulsion layer a specific type compound that not only acts as an agent to bond the emulsion effectively to the conductive layer but also crosslinks the emulsion layer and any overcoat layer that may be present without affecting the general properties of the recording film.

DISCLOSURE OF THE INVENTION

In accordance with this invention there is provided an electron beam recording film comprising a film support bearing, in order, A. a sputtered layer of indium-tin oxide, and B. a gelatino silver halide emulsion layer crosslinked with 2 to 10% by weight based on the weight of gelatin in the emulsion layer of a $Cr^{+3}$-containing compound.

In accordance with another embodiment of this invention there is provided a process for the preparation of an electron beam recording film comprising a film support bearing, in order, A. a sputtered layer of indium-tin oxide, and B. a gelatino silver halide emulsion layer crosslinked with at least 2% by weight based on the weight of gelatin in the emulsion layer of a $Cr^{+3}$-containing compound, the improvement where (a) injecting the $Cr^{+3}$-containing compound into a sensitized gelatino silver halide emulsion, (b) coating the support having the sputtered layer of indium-tin oxide with the emulsion having the $Cr^{+3}$-containing compound, and (c) drying the emulsion coating.

The electron beam recording film of the invention, as disclosed herein, is useful in the field of oil exploration wherein an electron beam recording device provided with an electron beam can be used to bombard a roll of the electron beam recording film which passes in front of and in the range of the beam. The electron beam "writes" on the recording film in the same manner that it would on a phosphor screen to produce a visible image. The electron beam produces a latent image in the silver grains of the film's emulsion layer. As the electrons strike the emulsion crystals in the film, some of the energy is consumed in forming a latent image in the crystal and some of the original energy is released in the form of lower energy secondary electrons. These secondary electrons can gradually produce a build-up of charge on the surface of the film that in turn will cause a deflection of the newly arriving imaging electrons. This deflection will result in a distorted image. By providing a highly conductive layer under the emulsion, these secondary electrons are bled off, eliminating the negative charge on the surface of the film, with the result that an accurate, undistorted image is achieved. The latent image formed in the silver halide emulsion layer is preferably reversal developed to give a positive image, e.g., as illustrated in Example 1 below; is capable of being enlarged to give a negative image, e.g., of oil exploration graphs and data, the negative image subsequently being used to make contact positive prints on diazo or silver halide contact speed paper. Reversal processing requires that the electron beam recording film be durable to withstand the reversal processing fluids.

In contrast to other electron beam recording films, e.g., the films described in Trevoy U.S. Pat. No. 3,428,451, the film of this invention is relatively simple having a support, a sputtered layer of indium oxide-tin oxide (ITO), a gelatin silver halide emulsion and, optionally, but preferably a gelatin overcoat layer, in its simplest embodiment. Onto a suitable film support, subbed or unsubbed, is sputtered a layer of indium oxide and tin oxide. Suitable film supports include: a polyester film such as polyethylene terephthalate, which is preferred, or other film to which a transparent conductive ITO layer may be applied, e.g., cellulosic supports, e.g., cellulose acetate, cellulose triacetate, cellulose mixed esters, etc.; polymerized vinyl compounds, e.g. copolymerized vinyl acetate and vinyl chloride, polystyrene, polymerized acrylates, etc.; polycarbonate; those formed from the polyesterification product of a dicarboxylic acid and a dihydric alcohol made according to the teachings of Alles, U.S. Pat. No. 2,779,684 and the patents referred to in the specification thereof, the disclosures of which are incorporated herein by reference. The amount of the indium oxide ($In_2O_3$) and tin oxide ($SnO_2$) can range from 80 to 99 and 1 to 20% by weight, respectively. Preferably, the ITO layer thickness ranges from 0.005 to 0.02 μm. Larger thicknesses, e.g., up to 0.1 μm and more, can be used but are not preferred due to their larger thickness and expense of formation. The resistance value of the ITO layers can range from 4000 to 400 ohms/square or less. The literature has reported resistivity of ITO layers as low as 50 ohms/square. The sputtered indium-tin oxide layer is then coated with a gelatino silver halide emulsion. Preferably the silver halide emulsion is silver iodobromide (1.1% iodide) having a grain size of about 0.31 to 0.34 μm on an edge (determined by Electrolytic Grain Size Analyzer (EGSA) as described by A. B. Holland and J. R. Sawers in "Grain Size Determination by Electrolytic Reduction", Photographic Science and Engineering, Vol. 17, No. 3, May/June 1973, pp 295–298. Other silver halide emulsions can be used, e.g., silver chloride, silver chlorobromide; monodisperse, heterodisperse, cover shell, tabular grain types, or the hybrid crystal types described by Haugh et. al. in U.S. Pat. No. 4,496,652. Both negative and direct positive emulsions can be employed. Grain size can be larger or smaller than 0.31 to 0.34 μm set out above; however, as one deviates widely from this range, there will be proportional gains or losses in sensitivity as well as image resolution and graininess. Similarly, the ratio of binder, e.g., gelatin, to silver can vary but gains and losses in image quality or emulsion durability may be experienced. (The ratio of binder/Ag is one factor influencing the dry and wet thickness of the emulsion layer; the other is the coating weight of the layer). While it is not necessary that the emulsions be chemically sensitized since the desired electron photographic speed can be achieved through grain characteristics and grain size, such sensitization can be used, if desired, particularly when finer grain emulsions are used. For example, useful chemical sensitizer include: sulfur sensitizers for negative emulsions which contain labile sulfur, e.g., allyl isothiocyanate, allyl diethyl thiourea, phenyl isothiocyanate, sodium thiosulfate; polyoxyalkylene ethers described in Blake et al., U.S. Pat. No. 2,400,532, and the polyglycols disclosed in Blake et al., U.S. Pat. No. 2,423,549. Non-optical sensitizers such as amines as taught by Staud et al., U.S. Pat. No. 1,925,508 and Chambers et al., U.S. Pat. No. 3,026,203, and metal salts as taught by Baldsienfen, U.S. Pat. No. 2,540, 86 may also be used. Fogging agents useful in preparing direct positive emulsions include amine boranes, borane hydrides, gold, tin and other reduction agents. A preferred fogging agent is cesium thiadecaborane. Preferably a gelatino overcoat layer is present on the silver halide emulsion layer primarily for protection. The dry thickness of the overcoat layer ranges from about 0.2 to 1.0 μm.

It is essential that the anchorage of the silver halide emulsion layer to the ITO conductive layer be sufficient to maintain the integrity of the film during transport, exposure and, in particular, liquid processing. The addition of at least 2% by weight, based on the weight of gelatin in the emulsion layer, of a $Cr^{+3}$ compound provides excellent anchorage. Suitable $Cr^{+3}$ compounds include: chrome alum (chromium potassium sulfate), chromic chloride, chromic sulfate, chromic nitrate, etc. The $Cr^{+3}$ compounds can be used in amounts up to about 10%, preferably about 5 to 7%, by weight, based on the weight of gelatin in the emulsion layer.

Prior to the present invention a wide range of hardeners were known for use with gelatino silver halide emulsions, overcoats, backing layers, antihalation layers, filter layers and subbing layers. In many of these layers it was common to use formaldehyde or glyoxal as the primary hardener in combination with generally no more than 1% by weight chrome alum as an auxiliary hardener. The chrome alum was added to increase the fresh melting point of the coated film, whereas formaldehyde or glyoxal would increase the film melting point over a period of months. It was known to a skilled artisan to avoid adding too much chrome alum to the emulsion since excessive cross-linking of gelatin would occur while the emulsion was being held for coating. Adding too much chrome alum to an emulsion would crosslink the gelatin to such an extent that coating problems such as gel slugs were encountered, and thus the emulsion could not be remelted and filtered.

As a result of what was known in the art about hardening gelatino silver halide emulsions and auxiliary layers, it was unexpected to discover that chrome alum and other $Cr^{+3}$ compounds can function as the sole hardener for a hardened film crosslinked to an electrically conductive layer on a support. It was further unexpected to find that attempts to combine formaldehyde or glyoxal with chrome alum to enhance film hardness had exactly the opposite effect, i.e., inorganic crosslinking provided by the chromium compound was destroyed by the organic addition and adhesion to the conductive layer decreased.

Another useful electron beam recording film of the invention contains between the ITO electrically conductive and the silver halide emulsion layer a $TIO_x$ layer, wherein x is equal to or greater than 2, e.g., 2 to 9, which is sputtered or deposited by an "electron beam" process on the ITO layer. This additional layer can be present to provide improved anchorage and to protect the ITO layer. The titanium oxide layer is generally of a thickness of 0.001 to 0.03 μm, preferably 0.015 to 0.02 μm.

The process of preparing the electron beam recording film of this invention is also believed to be unique. The ITO sputtered support is manufactured by procedures known to those skilled in the art, and as described above, may or may not contain on the electrically conductive surface a sputtered or electron beam deposited layer of a titanium oxide. A photographic silver halide emulsion, preferably an iodobromide emulsion (1.1% iodine), is prepared by standard preparation techniques, e.g., balanced double jet, single jet, splash, etc., to yield silver salt grains of about 0.31 to 0.34 μm on an edge. After washing and redispersing in gelatin, known surfactants or wetting agents; e.g., anionic types such as Fluorad®FC 127, a solution of 50% potassium N-ethyl-[(perfluoroctyl)sulfonyl]glycinate, 4% ethanol and 32% water, manufactured by 3M Co.; Triton®X-200, a 28% solution of a sodium alkylaryl polyether sulfonate, manufactured by Rohm & Haas Co.; Standapol®ES40, a 58% solution of a disodium alkyl sulfosuccinate, American Cyanamid Co., and amphoteric types, e.g., Product BCO®, alphatrimethylamino stearic acid, E. I. du Pont de Nemours and Company; Deriphat® 151, Sodium N-coca beta-aminopropionate, Henkel, Inc., U.S.A., etc., can be added to aid in coating the emulsions. If desired, standard chemical sensitizers as described above can be added. If a gelatin overcoat layer is used, a gelatin overcoat solution is prepared, e.g., containing about 2 to 6% by weight gelatin and preferably containing surfactants or wetting agents of the types described above used in the emulsion layer.

It has been found that relatively large amounts of $Cr^{+3}$ compound, e.g., as noted above, when present in the emulsion layer and overcoat layer, if the latter is present, provide effective wet and dry adhesion. This large amount of $Cr^{+3}$ in a silver halide emulsion can cause viscosity problems and prevent the emulsion from being prepared and tested prior to coating on its support. For example, when about 5% by weight $Cr^{+3}$ based on the weight of gelatin is added to a silver halide emulsion, the emulsion completely and irreversibly hardens in less than one hour. While it may be possible to add $Cr^{+3}$ in an amount of 7 to 10% by weight based on the weight of gelatin, and immediately make a laboratory coating for testing, this is unsatisfactory for film manufacture where the emulsion on a larger scale must remain stable over a period that may extend over many hours. To overcome the viscosity and hardening disadvantage, the $Cr^{+3}$ compound is added by injection whereby the chromium solution is injected, e.g., via a metering pump, into the line delivering emulsion to the coating bar. If an overcoat layer is used the chromium solution is added thereto in a similar manner. The two layers may be coated individually but preferably both layers are coated simultaneously using a two slot coating bar. A preferred chrome alum solution is 0.264 molar chromium potassium sulfate with a molecular weight of 499.39.

It is possible to overcome the disadvantage of increased viscosity by coating the ITO electrically conductive layer with a thin gelatin sub layer, e.g., containing about 7 to 10% by weight $Cr^{+3}$ in a low percent gelatin solution, e.g., 0.5 to 2.0% gelatin. An emulsion layer containing a lower amount of $Cr^{+3}$, e.g., 2 to 4% by weight is then coated on the electrically conductive layer. The $Cr^{+3}$ compound is regulated to avoid the potential viscosity problem. A preferred mode of the invention is illustrated in Example 5.

INDUSTRIAL APPLICABILITY

The electron beam recording film of this invention provides a means for converting seismic sections and aerial or satellite imagery which is usually on magnetic tape into high quality images which can be enlarged to provide a record which geophysicists, etc. can use. The film is generally useful to capture an image from a modulated electron beam.

EXAMPLES

The following examples wherein the percentages are by weight illustrate but do not limit the invention. Melting points are recordings based on visual observation of the temperature at which layer separation occurs as a sample is heated in water. A melting point of 35° C. indicates the sample polymer is unhardened gelatin. Surface resistance was measured with either a simple ohmmeter or a modified ohmmeter with flat probes suitable for surface resistance (reciprocal conductivity) measurement, i.e., a Fluke Model 8050A Digital Multimeter, John Fluke Manufacturing Co., Inc., Everett, WA.

Example 1

Cronar® polyethylene terephthalate photographic film manufactured by E. I. du Pont de Nemours and Company, Wilmington, DE base, both with and without resin and gel subbing layers, as described in Alles U.S. Pat. No. 2,779,684 was supplied to two commercial suppliers of sputtered metal oxide layers. The suppliers applied to the film surface using their equipment transparent and conductive layers of tin and indium oxide. One film sample consisted of 80% $In_2O_3$ and 20% $SnO_2$ and the other film sample consisted of 90% $In_2O_3$ and 10% $SnO_2$. The sputtered layer could be readily applied either on a subbing layer or on the untreated base surface. Measurements of the surface resistence of these tin and indium oxide layers showed resistance values as low as 500 ohms/ square.

A silver iodobromide (1.1.% iodide) emulsion was prepared by a balanced double jet (BDJ) procedures giving a core/shell distribution of AgBr/AgBrI/AgBr. The grain size was about 0.32 μm on an edge based on an EGSA (Electrolytic Grain Size Analyzer) measurement. The emulsion was washed to remove excess soluble salts and redispersed in gelatin with 0.25 g/gram of gelatin of Product BCO® alphatrimethylamino stearic acid, amphoteric surfactant, E. I. du Pont de Nemours and Company, added to aid coating. Gel/silver ratio was 1.38/1. No chemical or dye sensitization was used. A gelatin overcoat solution was also prepared containing 3.3% gelatin and 0.1 g and 0.125 g, respectively, of Product BCO® alphtrimethylamino stearic acid and Triton® X-200, 28% solution of sodium alkylaryl-polyether sulfonate surfactants per gram of gelatin. Immediately prior to coating the emulsion and overcoat layers as described below, a 13% solution of chrome alum (chromium potassium sulfate) in water at a pH of 3.1 was injected into the two coatings.

Using a bar coating apparatus equipped with metering pumps for emulsion and overcoat solution and two pumps for chrome alum injection, the emulsion and overcoat were simultaneously coated directly on the sputtered indium-tin oxide (ITO) surface of the two films giving a silver iodobromide emulsion coating weight of 3.2 g silver/$m^2$ and 4.4 g gelatin/$m^2$. The dry thickness of the overcoat layer was 0.5 μm. Table 1 below summarizes the ranges of pump metering rates for producing film useful for electron beam recording having good anchorage and wet processing properties.

TABLE 1

| Coating | Pump Rate (mL/min.) | Chrome Alum Conc. (%) | Injection Rate (mL/min.) |
|---|---|---|---|
| Emulsion, (3% silver analysis) | 500–600 | 10–16 | 8–14 |
| Overcoat (3.3% gel) | 180–220 | 1.0–1.6 | 15–40 |

The rolls of emulsion coated films were tested in a Texas Instruments Automatic Date Display (TIADD IV). Under vacuum conditions an electron beam scanned the surface of the film to expose the silver halide grains in proportion to original seismic data stored on magnetic tape. A single film exposure required about 30 seconds compared to 30 minutes required for CRT drum plotters or laser plotters.

The films were developed by reversal processing to provide a positive image. The reversal processing was accomplished in an Eastman Kodak Versamat® Reversal Processor at speeds from 2 to 8 feet/minute ~0.61 to 2.44 m/minute) using DuPont's Recron® reversal processing solutions. The steps involved area: first development, bleach, clear, overall flash exposure, second development, fix, wash and dry. Enlargements (10X) prepared from the images provided high quality seismic sections ready for copying by contact exposure on diazo paper.

Example 2

Example 1 was repeated except that the silver iodobromide (1.1% iodide) emulsion was prepared by BDJ procedure to provide a grain size of 0.18 μm on an edge. After washing and redispersing, the emulsion was chemically sensitized by adding sensitizing amounts of sulfur and gold sensitizers to adjust the electron beam speed. The emulsion was then digested for 100 minutes at 52°C. (125° F.). The results were comparable to those obtained with the films of Example 1.

Example 3

Example 1 was repeated except that in the redispersion step the gel/silver ratio was 1/1 accomplished by reducing the amount of gelatin present. In place of 10 to 25% of the gelatin a latex material, a 31% solids dispersion of polyethyl/acrylate latex, was added. By the procedure of this example, the curl tendencies of the film are reduced as are the forces that can interfere with anchorage of the emulsion to the sputtered ITO surface. There is also more coating latitude due to less risk of slugs, etc. being formed. Slugs of gelatin can cause coating defects during coating.

Example 4

Examples 1, 2 and 3 were repeated except that the overcoat solution was modified by adding particulate materials such as silica matte, rice starch matte and polyethylene beads (Poligen® available from BASF) in 0.05 g, 0.10 g and 0.21 g, per gram of gelatin, respectively. Pencil acceptance was improved, the tendency to form Newton rings was reduced and durability of the overcoat layer was increased.

Example 5

To biaxially oriented polyethylene terephthalate film, subbed on only one side with a resin sub and a gelatin sub as described in Alles U.S. Pat. No. 2,779,684, was sputtered on the unsubbed side of the film a layer of ITO consisting of 90% $In_2O_3$ and 10% $SnO_2$ having a surface resistance of 1000 ohms/square and a thickness of about 0.01 μm. By an electron beam deposition process a layer of a titanium oxide, 0.015 to 0.02 μm in thickness, was applied over the ITO layer. A dye backing was applied to the subbed side of the film to help observe coating defects.

An emulsion was prepared as described in Example 1 to give a final gel/silver ratio of 1 to 1. A 31% solids dispersion of polyethyl/acrylate latex was added to the emulsion at 0.35 g/gram of gelatin. The silver analysis was adjusted to 4% silver. A gelatin overcoating solution containing polyethylene beads was prepared as described in Example 4 with a 4% gelatin analysis.

The photographic emulsion and overcoating solution were coated by means of a "bar" coater at 150 feet/minute (45.7 m/minute) on the titanium oxide layer. 0.264 Molar chrome alum solution was injected into both the emulsion and overcoating solution by injecting into the delivery hoses at a rate of 0.53 mL/g of gelatin. The emulsion pump rate was 84 mL/minute for a coating weight of 3.2 g Ag/$m^2$ and the overcoating pump rate was 26 mL/minute for a coating weight of 1.09 grams of gelatin/$m^2$. After drying in a drier samples were taken for testing.

Melt measurements showed melting point is greater than 175° F. (90° C.) which shows a significant degree of hardening. Film processing in an Eastman Kodak Versamat® Reversal Processor as described in Example 1 showed no delamination or other film damage. Exposure tests on a TIADD IV and with electron beam exposure showed good image quality with no image distortion. 10X enlargements also showed good image quality with no distortion.

I claim:

1. An electron beam recording film comprising a film support bearing, in order, (A) a sputtered layer of indium-tin oxide, and (B) a gelatino silver halide emulsion layer crosslinked solely with 2 to 10% by weight based on the weight of gelatin in the emulsion layer of a $Cr^{+3}$-containing compound.

2. An electron beam recording film according to claim 1 wherein the $Cr^{+3}$-containing compound is chrome alum.

3. An electron beam recording film according to claim 1 wherein the $Cr^{+3}$-containing compound is chromic chloride.

4. An electron beam recording film according to claim 1 wherein present on the crosslinked gelatino silver halide emulsion layer is a gelatin overcoat layer crosslinked with 2 to 10% by weight based on the weight of gelatin of a $Cr^{+3}$-containing compound.

5. An electron beam recording film according to claim 1 wherein the silver halide emulsion is a silver iodobromide emulsion.

6. An electron beam recording film according to claim 1 wherein 5 to 7% by weight based on the weight of gelatin in the emulsion layer of a $Cr^{+3}$-containing compound is present.

7. An electron beam recording film according to claim 4 wherein 5 to 7% by weight based on the weight of gelatin in the overcoat layer of a $Cr^{+3}$-containing compound is present.

8. An electron beam recording film according to claim 1 wherein the support is a polyethylene terephthalate film support.

9. An electron beam recording film according to claim 1 having on the layer of indium-tin oxide a layer of $TiO_x$ where x is equal to or greater than 2.

10. A process for the preparation of an electron beam recording film comprising a film support bearing, in order:

(A) a sputtered layer of indium-tin oxide, and (B) a gelatino silver halide emulsion layer crosslinked solely with at least 2% by weight based on the weight of gelatin in the emulsion layer of a $Cr^{+3}$-containing compound, the improvement wherein (a) injecting the $Cr^{+3}$-containing compound into a sensitized gelatino silver halide emulsion, (b) coating the support having the sputtered layer of indium-tin oxide with the emulsion having the $Cr^{+3}$-containing compound, and (c) drying the emulsion coating.

11. A process according to claim 10 wherein additionally (d) injecting a $Cr^{+3}$-containing compound into a gelatino overcoat composition, and (e) coating the emulsion layer having the $Cr^{+3}$-containing compound with the gelatino overcoat layer containing the $Cr^{+3}$-containing compound, and (f) drying the overcoat layer.

12. A process according to claim 11 wherein the emulsion layer having the $Cr^{+3}$-containing compound and the gelatino overcoat layer containing the $Cr^{+3}$-containing compound are coated simultaneously on the support previously sputtered with the layer of indium-tin oxide.

13. A process according to claim 10 wherein the layer of indium-tin oxide is sputtered onto the support under an argon atmosphere.

14. A process according to claim 10 wherein the support is an unsubbed polyethylene terephthalate film support.

15. A process according to claim 10 wherein the $Cr^{+3}$-containing compound is chrome alum.

16. A process according to claim 10 wherein the $Cr^{+3}$-containing compound is chromic chloride.

17. A process according to claim 12 wherein the $Cr^{+3}$-containing compound is chrome alum.

18. A process according to claim 12 wherein the $Cr^{+3}$-containing compound is chromic chloride.

19. A process according to claim 10 wherein between the sputtered layer of indium-tin oxide and the emulsion layer is a layer of $TiO_x$ where x is equal to or greater than 2.

20. A process according to claim 11 wherein between the sputtered layer of indium-tin oxide and the emulsion layer is a layer of $TiO_x$ where x is equal to or greater than 2.

21. A process according to claim 10 wherein the range of $Cr^{+3}$-containing compound in the emulsion layer is 2 to 10% by weight based on the weight of gelatin in the emulsion layer.

22. A process according to claim 10 wherein the support having the sputtered layer of indium-tin oxide is coated with the emulsion substantially immediately after having the $Cr^{+3}$-containing compound injected therein.

* * * * *